US011547249B2

(12) United States Patent
Savino

(10) Patent No.: US 11,547,249 B2
(45) Date of Patent: Jan. 10, 2023

(54) SHOWER CURTAIN WITH BUILT-IN SPLASH GUARD

(71) Applicant: Elisavet Savino, Livingston, NJ (US)

(72) Inventor: Elisavet Savino, Livingston, NJ (US)

( * ) Notice: Subject to any disclaimer, the term of this patent is extended or adjusted under 35 U.S.C. 154(b) by 127 days.

(21) Appl. No.: 16/811,246

(22) Filed: Mar. 6, 2020

(65) Prior Publication Data

US 2020/0281415 A1 Sep. 10, 2020

Related U.S. Application Data

(60) Provisional application No. 62/919,300, filed on Mar. 8, 2019.

(51) Int. Cl.
*A47K 3/30* (2006.01)

(52) U.S. Cl.
CPC ..... *A47K 3/302* (2013.01); *A47K 2003/307* (2013.01)

(58) Field of Classification Search
CPC ..... A47K 3/302; A47K 2003/307
USPC ..... 4/607, 608, 557, 558
See application file for complete search history.

(56) References Cited

U.S. PATENT DOCUMENTS

| | | | | |
|---|---|---|---|---|
| 2,049,061 | A | 7/1936 | Hoegger | |
| 2,608,250 | A | 8/1952 | Meyer | |
| 2,771,945 | A * | 11/1956 | Wittrup | A47K 3/38 4/608 |
| 4,070,735 | A | 1/1978 | Canaday | |
| 4,759,087 | A | 7/1988 | Zeilinger | |
| 5,148,580 | A * | 9/1992 | Dyckow | A47K 3/38 4/608 |
| 5,421,393 | A | 6/1995 | Wolfe | |
| 5,911,265 | A * | 6/1999 | Dreher | A47H 23/04 160/124 |
| 6,192,965 | B1 | 2/2001 | Hinds | |
| 6,336,232 | B1 | 1/2002 | Toder | |
| 6,845,525 | B2 | 1/2005 | Bathurst | |
| 9,192,267 | B2 | 11/2015 | Tsibulevskiy | |
| 2007/0199143 | A1* | 8/2007 | Cunningham | A47K 3/38 4/558 |
| 2008/0017332 | A1 | 6/2008 | Daly | |
| 2011/0099710 | A1* | 5/2011 | Whitmore | A47K 3/38 4/609 |

* cited by examiner

*Primary Examiner* — Tuan N Nguyen

(57) ABSTRACT

A shower curtain having a fabric body and a detachment member. The fabric body includes a top edge, a bottom edge, a first side edge and a second side edge. The detachment member is substantially parallel to the top edge and bottom edge and intersects the first side edge. When the detachment member is in a detached position, the fabric body has an upper fabric portion that is separated from a lower fabric portion such that the upper fabric portion is configured to move independently from the lower fabric portion.

9 Claims, 2 Drawing Sheets

SHOWER CURTAIN WITH BUILT-IN SPLASH GUARD

PRIORITY CLAIM/INCORPORATION BY REFERENCE

This application claims priority to U.S. Provisional Application Ser. No. 62/919,300 filed on Mar. 8, 2019 and entitled "Shower curtain with built-in splash guard", the entirety of which is incorporated herein by reference.

BACKGROUND INFORMATION

Parents, caregivers, and pet-owners face difficulty using a conventional shower curtain to assist children, patients, or pets. A traditional shower curtain can either be closed completely, which does not allow the assisting party to reach in and provide assistance to the person or pet in the shower. On the other hand, the shower curtain may be pulled back to provide access. However, in this scenario water from the shower may be displaced onto the floor of the room rather than the shower pan or bathtub. The result is a difficult shower experience and/or displaced water. Splashing water may damage floors and bathroom fixtures and present a slipping hazard. A traditional shower leaves the caregiver with little access and an arduous cleanup. Therefore, there exists a need for a shower curtain to prevent excess splashing while allowing for the assisting caregiver to access the child, patient, or pet from outside the shower.

SUMMARY

Exemplary embodiments describe a shower curtain having a fabric body and a detachment member. The fabric body includes a top edge, a bottom edge, a first side edge and a second side edge. The detachment member is substantially parallel to the top edge and bottom edge and intersects the first side edge. When the detachment member is in a detached position, the fabric body has an upper fabric portion that is separated from a lower fabric portion such that the upper fabric portion is configured to move independently from the lower fabric portion.

DETAILED DESCRIPTION OF THE INVENTION

Figure 1:
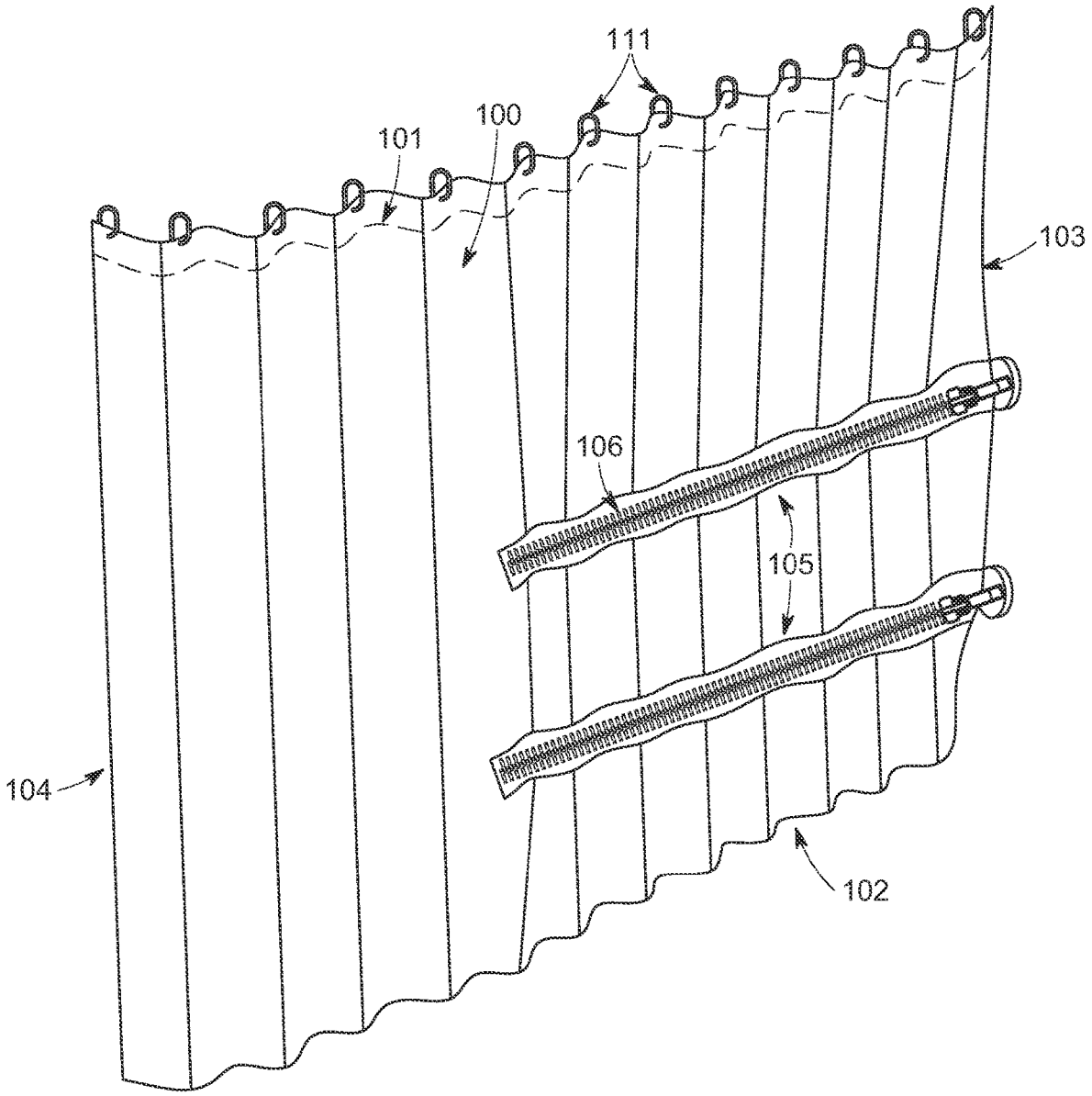
FIG. 1 shows an exemplary embodiment of a shower curtain according to various exemplary embodiments.

The exemplary embodiments may be further understood with reference to the following description and appended drawings, wherein like elements are referred to with the same reference numerals. The exemplary embodiments describe a shower curtain with a built-in splash guard. While the exemplary embodiments are described with reference to a shower curtain, those skilled in the art will understand that the exemplary embodiments may apply equally to a shower curtain liner. Thus, when the term "shower curtain" is used throughout this description, it may be used to refer to any article that is designed to close a shower enclosure and generally prevent water from leaving the shower area.

In addition, the exemplary embodiments are described with the shower curtain being used for a shower enclosure. The shower enclosure may include any area that includes a shower, such as a bathtub area, an enclosure that includes a shower, etc. Thus, the terms shower enclosure, shower, and bathtub may be used interchangeably throughout this description.

The exemplary shower curtain may be comprised of any plastic or cloth material, such as those traditionally used in domestic shower curtains and/or shower liners or any other natural or synthetic material used in clinical settings. Throughout this description, the material from which the shower curtain is constructed may be referred to as a fabric. The term fabric should be understood to encompass any of the materials described above.

FIG. 1 illustrates an exemplary shower curtain 100 comprising an elongated, horizontal top edge 101 that is parallel to an elongated, horizontal lower edge 102. The shower curtain 100 also comprises an elongated, vertical first edge 103 and an elongated, vertical second edge 104 that is parallel to the first edge 103. It should be understood that FIG. 1 shows the shower curtain 100 in an operable position, e.g., as it would appear hanging from a shower rod. Thus, the designations of top edge 101 and lower edge 102 are described relative to this orientation. Moreover, the shower curtain 100 in FIG. 1 is shown in a generally extended position, e.g., where the shower curtain 100 is generally flat and extended across substantially the entire opening of the shower enclosure. Those skilled in the art will understand that the shower curtain 100 may also be moved to an open position by moving the first edge 103 toward the second edge 104 or vice versa. When this occurs the shower curtain 100 will bunch in a manner generally resembling an accordion.

The top edge 101 comprises a plurality of attachments 111 that may be used to attach the shower curtain 100 to a shower rod or other supporting structure. The top edge 101 of the shower curtain 100 comprises a plurality of eyelets (reinforced or unreinforced) or grommets where a ring or other attachment mechanism may secure the shower curtain 100 to the rod or supporting structure above. The top edge 101 of the shower curtain 100 may be adjusted along the length of the shower rod or supporting structure to occlude the entire shower housing, preventing water from splashing into the area outside the shower. Those skilled in the art will understand that the exemplary embodiments are not limited to any manner of attaching the shower curtain 100 to the shower enclosure and the above description is provided to show one exemplary manner of attaching the shower curtain 100 to the shower enclosure.

The lower edge 102 comprises an edge running along the bottom of the shower enclosure. The lower edge 102 may contact the lower portion of the shower enclosure on the inside area of the shower (e.g., an inner wall of a bathtub), thus creating a water-impermeable barrier along the lower edge 102 of the shower curtain 100. The lower edge 102 may include weighted or magnetic elements to reinforce the water-impermeable barrier.

The two parallel, vertical edges 103 and 104 connect the elongated horizontal edges 101 and 102. The four edges 101-104 create a substantially quadrilateral shaped fabric body that occludes the opening of the shower enclosure. Those skilled in the art will understand that the shower curtain 100 may be sized to appropriately fit the opening of any shower enclosure. In one exemplary embodiment, the shower curtain 100 may have dimensions of 72"×72". In another exemplary embodiment, the shower curtain 100 may have dimensions of 57"×74." However, as stated above, these dimensions are only exemplary, and the shower curtain may be sized and shaped to any appropriate dimensions for the shower enclosure for which the shower curtain 100 will be used.

FIG. 1 also shows the shower curtain 100 comprises two elongated, horizontal running detachment members 105 that intersect the first edge 103. As will be described in greater detail below, the detachment members 105 allow a portion of the shower curtain 100 to be removed from the opening of the shower enclosure without fully opening the shower curtain 100. It should be understood that the use of two detachment members 105 is only exemplary. The exemplary shower curtain 100 may have more or less detachment members 105. The elongated detachment members 105 originate at the first edge 103 at various heights along the edge and each extend to a detachment member termination point 106. As shown in FIG. 1, the detachment member termination points 106 is at a point that is not the full width of the shower curtain 100, e.g., the detachment members 105 do not extend the full width of the shower curtain 100 from the first edge 103 to the second edge 104. The exact location of the detachment member termination points 106 may be based on the amount of access that the user desires and the width of the shower enclosure.

FIG. 1 also shows the second edge 104 that is parallel to the first edge 103. As described above, in this exemplary embodiment, the detachment members 105 do not intersect the second edge 104. However, it should be understood that the shower curtain 100 may be reflected over the y-axis to accommodate shower housings with different faucet or shower head placement, e.g., the detachment members 105 may intersect with the second edge 104 and not the first edge 103.

Figure 2:
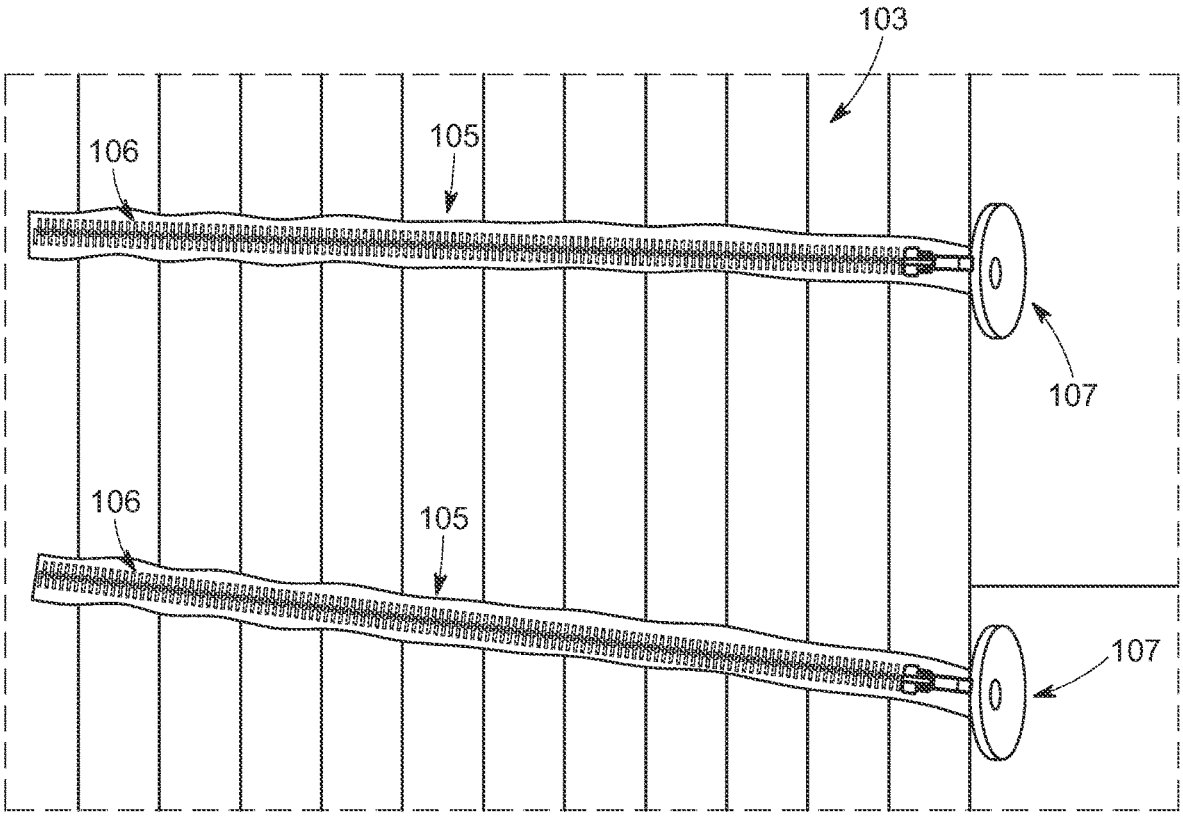
FIG. 2 shows an exemplary embodiment of the attachment mechanism and an exemplary embodiment of the detachment mechanism later described.

FIG. 2 shows a further view of the exemplary shower curtain 100 that focuses on the elongated detachment members 105 according to various exemplary embodiments. As described above, the detachment members 105 originate at first edge 103 and run generally horizontal (e.g., generally parallel to the top edge 101 and the lower edge 102) to detachment member termination points 106. Detachment termination points may be located on the fabric body of the shower curtain or on the opposite vertical edge. Each elongated detachment member 105 comprises an attachment/detachment mechanism that may include, for example, zippers, buttons, or Velcro™. In one exemplary embodiment, the detachment member 105 may include a two-sided zipper that has handles on the shower facing side and the outward facing side of the body of the shower curtain 100. The dual-sided zipper may allow for the detachment mechanism to be engaged from either inside or outside of the shower.

The detachment member 105 may be used to release the material below the detachment member 105 from the material above the detachment member 105. The released upper material may then be moved aside allowing for an access point from outside the shower enclosure to the inside of the shower. An example of this use case will be provided below with reference to FIG. 3.

FIG. 2 also shows a plurality of attachment members 107 that may be attached to a vertical surface of the shower enclosure proximate to the first edge 103. As will be described in greater detail below, the attachment members 107 may be used to support the shower curtain 100 when one or more of the detachment members 105 are opened, e.g., the top portion of shower curtain 100 material is separated from the bottom portion of the shower curtain 100 material. The attachment members 107 may comprise, for example, a suction cup attached to or near the first edge 103 of the shower curtain that may then be attached to the vertical surface of the shower enclosure. In another exemplary embodiment, the attachment member 107 may comprise a first anchoring mechanism (e.g., suction cup, eyelet, magnet, etc.) that may be permanently or semi-permanently placed on the vertical edge of the shower enclosure and a second attachment portion that is coupled to the shower curtain at or near the first edge 103. The second attachment portion may be used to couple to the first anchoring mechanism when the first edge 103 is placed in a position near the vertical edge of the shower enclosure that includes the first anchoring mechanism. The anchoring mechanism and attachment portion may include a hook-and-ring closure, a magnetic system, etc.

Figure 3:
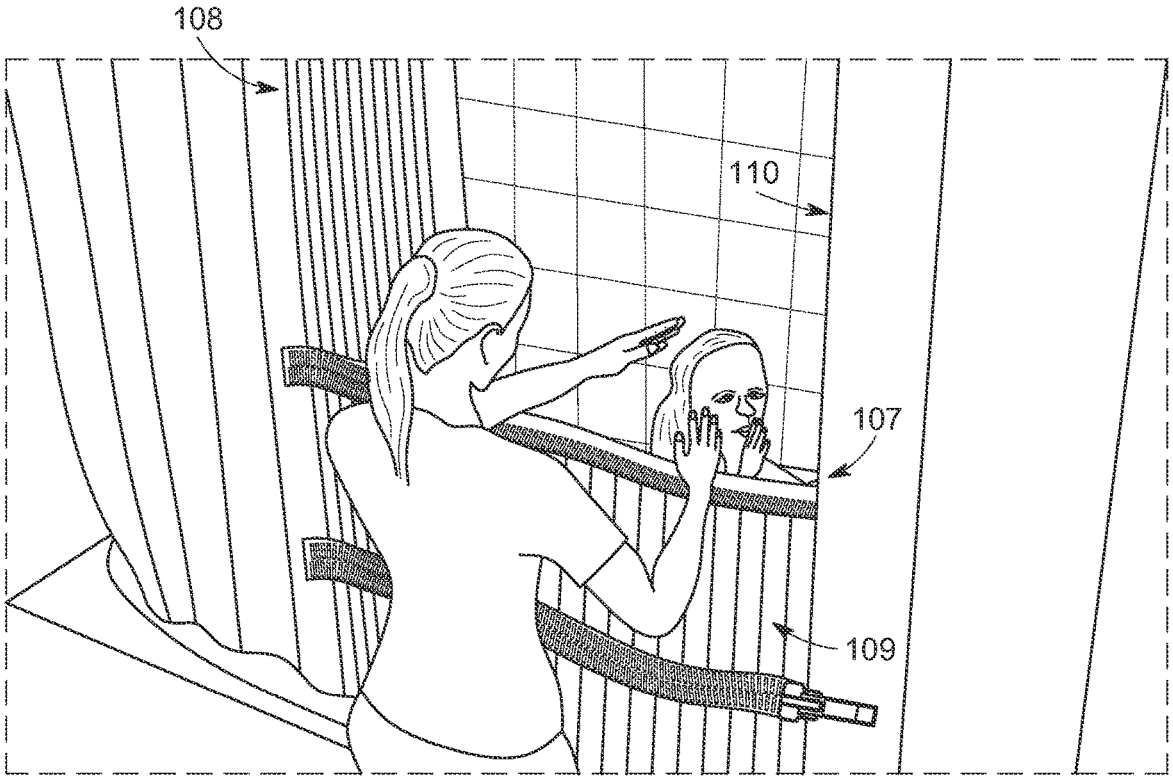
FIG. 3 shows an exemplary embodiment in which both the attachment mechanism and detachment mechanism are both engaged and the shower curtain is in use.

FIG. 3 shows an exemplary embodiment of the shower curtain 100 with one of the detachment members 105 in use. In this example, the upper detachment member 105 has been used to separate the fabric of the upper portion 108 of the shower curtain 100 from the fabric of the of the lower portion 109 of the shower curtain 100. The attachment member 107 couples with the vertical surface 110 of the shower housing 110. The coupling provides tensile support to suspend the lower portion 109 of the detached fabric and remain in the closed position with respect to the shower enclosure. That is, if the attachment members 107 did not couple the lower portion 109 of fabric to the vertical surface 110 of the shower enclosure, the lower portion 109 would fall into the shower area.

The upper portion 108 of detached material may be moved aside, allowing for the caregiver outside the shower to access the inside of the shower enclosure. In this manner, the lower portion 109 of detached fabric remains in the closed position with respect to the shower enclosure and prevents water from inside the shower from splashing into the area outside the shower. The caregiver may use any of the detachment members 105 based on the type of access that is needed. For example, as shown in FIG. 3, the upper detachment member 105 may be used for larger children and adults. The lower detachment member 105 may be used when a small child or a small pet is in the shower enclosure because it may allow access to a lower part of the shower enclosure.

Although this application described various embodiments each having different features in various combinations, those skilled in the art will understand that any of the features of one embodiment may be combined with the features of the other embodiments in any manner not specifically disclaimed or which is not functionally or logically inconsistent with the operation of the device or the stated functions of the disclosed embodiments.

It will be apparent to those skilled in the art that various modifications may be made in the present disclosure, without departing from the spirit or the scope of the disclosure. Thus, it is intended that the present disclosure cover modifications and variations of this disclosure provided they come within the scope of the appended claims and their equivalent.

What is claimed:

1. A shower curtain comprising:

a fabric body having a top edge, a bottom edge, a first side edge and second side edge;

a plurality of detachment members, wherein each detachment member is substantially parallel to the top edge and bottom edge and intersects the first side edge, wherein said detachment member comprises a zipper having an upper member and a lower member that are detachable to separate said fabric body into an upper fabric portion and a lower fabric portion; and an attachment member located at an end of said lower member of said detachment member that intersect the first side edge and configured to secure the detachment member to a wall of a shower stall; wherein, when said detachment member is in a detached position, and the attachment member secured to the wall, the upper fabric portion is separated from the lower fabric portion such that the upper fabric portion is configured to move independently from the lower fabric portion to create an access window into the shower stall while the lower fabric portion is suspended to the wall by the attachment member to create a lower portion splash guard.

2. The shower curtain of claim 1, wherein said plurality of detachment members are disposed at a different horizontal location relative to the first side edge allowing for different height positions of the access window.

3. The shower curtain of claim 1, wherein said zipper comprises a two-sided zipper, such that a first zipper handle is located on an inside surface of the shower curtain allowing for the detachment mechanism to be engaged from inside of the shower stall and a second zipper handle is located on an outside surface of the shower curtain allowing for the detachment mechanism to be engaged from outside of the shower stall.

4. The shower curtain of claim 1, wherein the attachment member comprises a magnet configured to attach to a corresponding magnet of the shower stall.

5. The shower curtain of claim 1, wherein the attachment member comprises a hook-and-ring attachment configured to attach to a corresponding hook-and-ring attachment of the shower enclosure.

6. The shower curtain of claim 1, wherein the attachment member comprises a suction cup.

7. The shower curtain of claim 1, wherein the attachment member comprises a nylon fabric coupling system configured to attach to a corresponding nylon fabric coupling system of the shower enclosure.

8. The shower curtain of claim 1, wherein the fabric body comprises a waterproof material.

9. The shower curtain of claim 8, wherein the waterproof material is one of a plastic or a synthetic fiber.

* * * * *